US005372534A

United States Patent [19]

Levy et al.

[11] Patent Number: 5,372,534

[45] Date of Patent: Dec. 13, 1994

[54] VARIABLE GEOMETRY CONVEYANCE

[76] Inventors: Richard C. Levy, P.O. Box 34828, Bethesda, Md. 20827; Richard J. Maddocks, 302 Lexington Dr., Silver Spring, Md. 20901

[21] Appl. No.: 986,564

[22] Filed: Dec. 7, 1992

[51] Int. Cl.[5] ..... A63H 17/00; A63H 17/267; A63H 29/22

[52] U.S. Cl. ..... 446/457; 446/469; 446/462; 446/470; 180/209; 280/11.22

[58] Field of Search ..... 180/209, 906; 280/11.22, 11.19, 239, 38, 639, 282; 446/462, 465, 469, 457, 436, 466, 470

[56] References Cited

U.S. PATENT DOCUMENTS

| | | | |
|---|---|---|---|
| 280,236 | 6/1883 | Phillips | 280/11.19 |
| 561,798 | 6/1896 | Lawson | 280/239 X |
| 601,231 | 3/1898 | Blackburn . | |
| 1,188,377 | 6/1916 | Weaver | 280/11.19 |
| 2,159,974 | 5/1939 | Lohr . | |
| 2,841,408 | 7/1958 | Mariotte | 280/38 |
| 3,046,032 | 7/1962 | Humphries | 280/11.19 |
| 3,086,787 | 4/1963 | Wyche | 280/11.19 |
| 3,414,280 | 12/1968 | Ohashi | 280/11.19 |
| 3,649,038 | 3/1972 | Huckenbeck | 280/11.28 |
| 3,891,228 | 6/1975 | Rhinehart et al. | 280/36 |
| 3,901,520 | 8/1975 | McMahan | 280/7.13 |
| 3,964,762 | 6/1976 | Adams | 280/439 |
| 4,393,620 | 7/1983 | Murakami | 446/470 X |
| 4,718,875 | 1/1988 | McKittrick et al. | 446/231 |
| 4,810,229 | 3/1989 | Shoji | 446/443 |
| 4,850,929 | 7/1989 | Genevey | 446/466 |

FOREIGN PATENT DOCUMENTS

| | | | |
|---|---|---|---|
| 11025 | of 1904 | United Kingdom | 180/906 |

*Primary Examiner*—Mickey Yu
*Attorney, Agent, or Firm*—Nixon & Vanderhye

[57] ABSTRACT

The variable geometry wheeled conveyance includes front and rear pairs of wheels carried by a frame longitudinally spaced from one another for rotation about longitudinally spaced axes in a first configuration of the conveyance. A parallelogram linkage connects the wheels and the frame. By displacing the linkage, the wheels are movable into a second configuration with each wheel being rotatable about a transverse axis longitudinally spaced from every other wheel. A timer initiates transformation from the first to the second configuration and also causes a change in a gear ratio from the drive motor to the wheels to simultaneously upon such transformation change the speed of the conveyance.

25 Claims, 5 Drawing Sheets

VARIABLE GEOMETRY CONVEYANCE

BACKGROUND OF THE INVENTION

The present invention relates to a variable geometry conveyance, such as a wheeled vehicle, having front and rear wheels, and the capability to transform between first and second wheeled configurations.

In the present description, the invention is described in relation to a toy vehicle, although it will be appreciated that the invention is more broadly applicable to conveyances in general, including vehicles such as automobiles or trucks; skateboards; roller skates and the like. Further, the term "first" configuration of the conveyance, as used herein, means a wheeled conveyance movable in a longitudinal direction on at least three wheels with two of the wheels being rotatable about longitudinally spaced, transversely extending axes and in which configuration two of the three wheels establish a predetermined track. Additionally, the term "in-line," "tandem" or "second" configuration, as used herein, means a wheeled conveyance which is movable in a longitudinal direction on at least two wheels on longitudinally spaced, transversely extending axes and in which configuration the two wheels have a track less than the predetermined track established by the two wheels of the conveyance when in the first configuration and including a track equal to zero. As used herein, the term "track" means the transverse distance between wheels measured to planes extending through their centerlines and in the longitudinal direction of travel.

In a preferred embodiment hereof, pair of front and rear wheels are provided and may be displaced from a typical four-wheel, hence first conveyance, configuration, to a second configuration wherein the axes of all of the wheels are transversely parallel to and non-coincident with one another. The term "in-line," "tandem" or "second" configuration also embraces within its meaning and, unless otherwise specified, both a staggered wheel arrangement wherein the wheels are longitudinally, as well as transversely, spaced one from the other and a configuration wherein all wheels are in longitudinal alignment one with the other, i.e., a zero track. It will also be appreciated that the conveyance hereof, at a minimum, has at least three wheels with at least two of the wheels longitudinally spaced from one another in the first configuration and two wheels having transverse axes longitudinally spaced from one another in a second configuration. Hence the conveyance may include a tricycle with three wheels in a typical tricycle configuration or preferably a four-wheeled conveyance.

In accordance with a preferred embodiment of the present invention, a conveyance may be transformed or converted from the first configuration with front and rear wheels on longitudinally spaced axes, e.g. a front wheel and a pair of rear wheels (tricycle configuration) or more typically front and rear pairs of wheels, to the second configuration, where wheels are in-line or tandem and transformable or convertible back to the first configuration. The transformation from one configuration to the other may be accomplished manually, with the wheels being releasably locked and unlocked in each configuration for displacement toward the other configuration. Alternatively, the transformation from one configuration to the other may be powered, for example, by employing a spring which biases the wheels for movement from one configuration toward the other configuration. For example, a wheel assembly may be locked in a standard four-wheel configuration with a spring biasing the wheel assembly for movement of the wheels into the second configuration. By manually unlocking the wheels in the four-wheel configuration, the wheel assembly under the bias of the spring may be displaced toward and into the second configuration. The wheels in the second configuration may be returned to the first configuration either manually or under power.

A timing mechanism is also provided in accordance with the present invention such that the transformation or conversion of the conveyance from one configuration to the other may be accomplished while the conveyance is moving in the longitudinal direction. Still further, the conveyance of this invention may be powered or unpowered. For example, the conveyance may have a spring-loaded or electric motor, a motor which may be manually activated, for example, an inertia wheel, a clock spring mechanism, radio control, a pull-back motor or any other type of suitable power source. Also, the conveyance may be employed in conjunction with a launcher or catapult mechanism whereby the conveyance is freewheeling once launched from the catapult or launcher. Whether powered or unpowered, the conveyance may be transformed between configurations initially or while moving. Furthermore, the conveyance may have a mechanism responsive to the transformation or conversion from one configuration to the other for changing the speed of the conveyance. For example, the conveyance may be driven at one speed in a first configuration and, using a timer mechanism, may be converted to the second configuration, while simultaneously a speed-change mechanism is actuated to increase the speed of the conveyance. Alternatively, radio control may be used to remotely effect the transformation and the speed change.

The conveyance in a preferred embodiment includes a frame, pairs of front and rear wheels, and a means for connecting the frame and the wheels to one another, enabling transformation of the conveyance from the four-wheel configuration into the tandem wheel configuration. The connecting means may take the form of a parallelogram linkage, i.e., a pair of longitudinally extending, transversely spaced side elements interconnected adjacent their ends by longitudinally spaced, transversely extending end or cross-link elements. The front and rear wheels are connected to this linkage adjacent the pivots of the linkage and each wheel is mounted for rotation about an axis independent of the axis of any other other wheel, although, as will be seen from the ensuing description, one of the pair of front or back wheels is jointly driven in a preferred embodiment of the invention.

In a preferred embodiment according to the present invention, there is provided a variable geometry wheeled conveyance comprising a main frame, and in a first configuration, front and rear pairs of wheels carried by the frame longitudinally spaced from one another for rotation about longitudinally spaced, transversely extending, front and rear axes, respectively, enabling the conveyance for movement in a longitudinal direction, and means connecting the frame and the front and rear pairs of wheels for enabling displacement of the wheels from the first configuration to a second configuration wherein each wheel is rotatable about a discrete, transversely extending axis spaced longitudinally of the axis of each other wheel of the front and rear pairs of wheels, enabling the conveyance for movement in the longitudinal direction.

In a further preferred embodiment according to the present invention, there is provided a variable geometry wheeled conveyance comprising a main frame, front and rear pairs of wheels, means connecting the front and rear pairs of wheels and the main frame establishing first and second configurations of the conveyance, the pairs of front and rear wheels in the first configuration being longitudinally spaced from one another for rotation about longitudinally spaced, transversely extending front and rear axes, respectively, enabling the conveyance for movement in a longitudinal direction, each wheel of the front and rear pairs of wheels in the second configuration being rotatable about a discrete transversely extending axis spaced longitudinally of the axis of each other wheel of the front and rear pairs thereof enabling the conveyance for movement in the longitudinal direction. The connection means enable displacement of the wheels from one of the first and second configurations to another of the first and second configurations.

In a further preferred embodiment according to the present invention, there is provided a variable geometry wheeled conveyance comprising a main frame, a first wheel carried by the frame and a pair of wheels carried by the frame. Means are provided connecting the pair of wheels and the frame establishing, with the first wheel, first and second configurations of the conveyance, the pair of wheels and the first wheel in the first configuration being longitudinally spaced from one another for rotation about longitudinally spaced, transversely extending, first and second axes, respectively, enabling the conveyance for movement in a longitudinal direction. Each wheel of the first wheel and the pair of wheels, in the second configuration is rotatable about a discrete, transversely extending axis spaced longitudinally of the axis of each other wheel of the first wheel and the pair of wheels enabling the conveyance for movement in the longitudinal direction in the second configuration thereof, with the connecting means enabling displacement of the pair of wheels from one of the first and second configurations to another of the first and second configurations.

In a further preferred embodiment according to the present invention, there is provided a variable geometry wheeled conveyance comprising a main frame, a plurality of wheels carried by the frame, with three of the plurality of wheels establishing a first configuration with a pair of the three wheels being rotatable about longitudinally spaced, transversely extending axes and two of the three wheels establishing a predetermined track. At least two of the plurality of wheels are longitudinally spaced and rotatable about transversely extending discrete axes establishing a second configuration having a track less than the predetermined track. Means interconnect the frame and the wheels for changing the configuration of the conveyance between the first configuration and the second configuration.

It is therefore a primary object of the present invention to provide a novel and improved variable geometry conveyance which may be transformed between different wheeled configurations.

There and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to a present preferred embodiment of the invention, an example of which is illustrated in the accompanying drawings.

Figure 1:
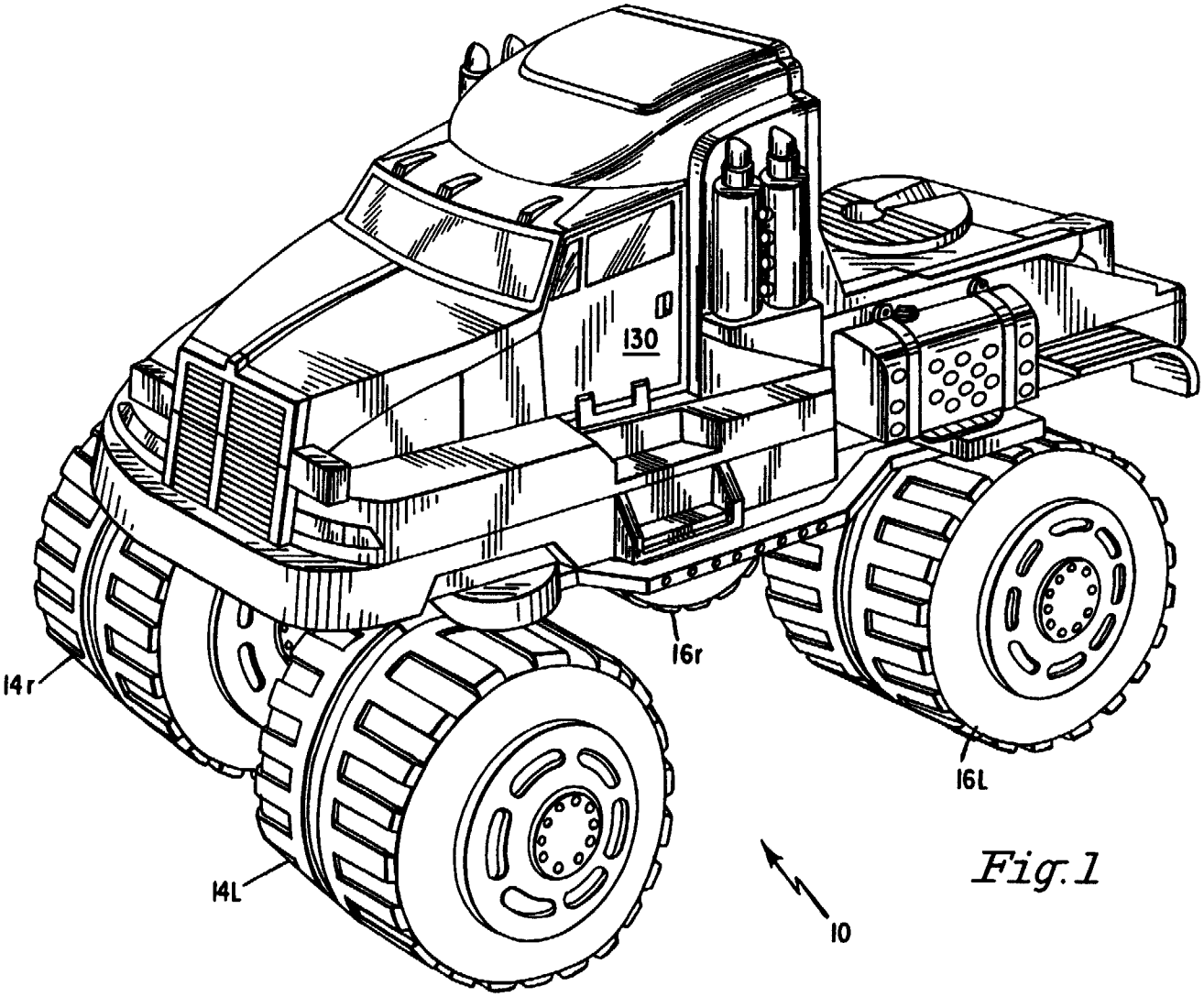
FIGS. 1 and 2 are perspective views of a conveyance in first and second configurations according to a preferred embodiment of the present invention.
Figure 2:
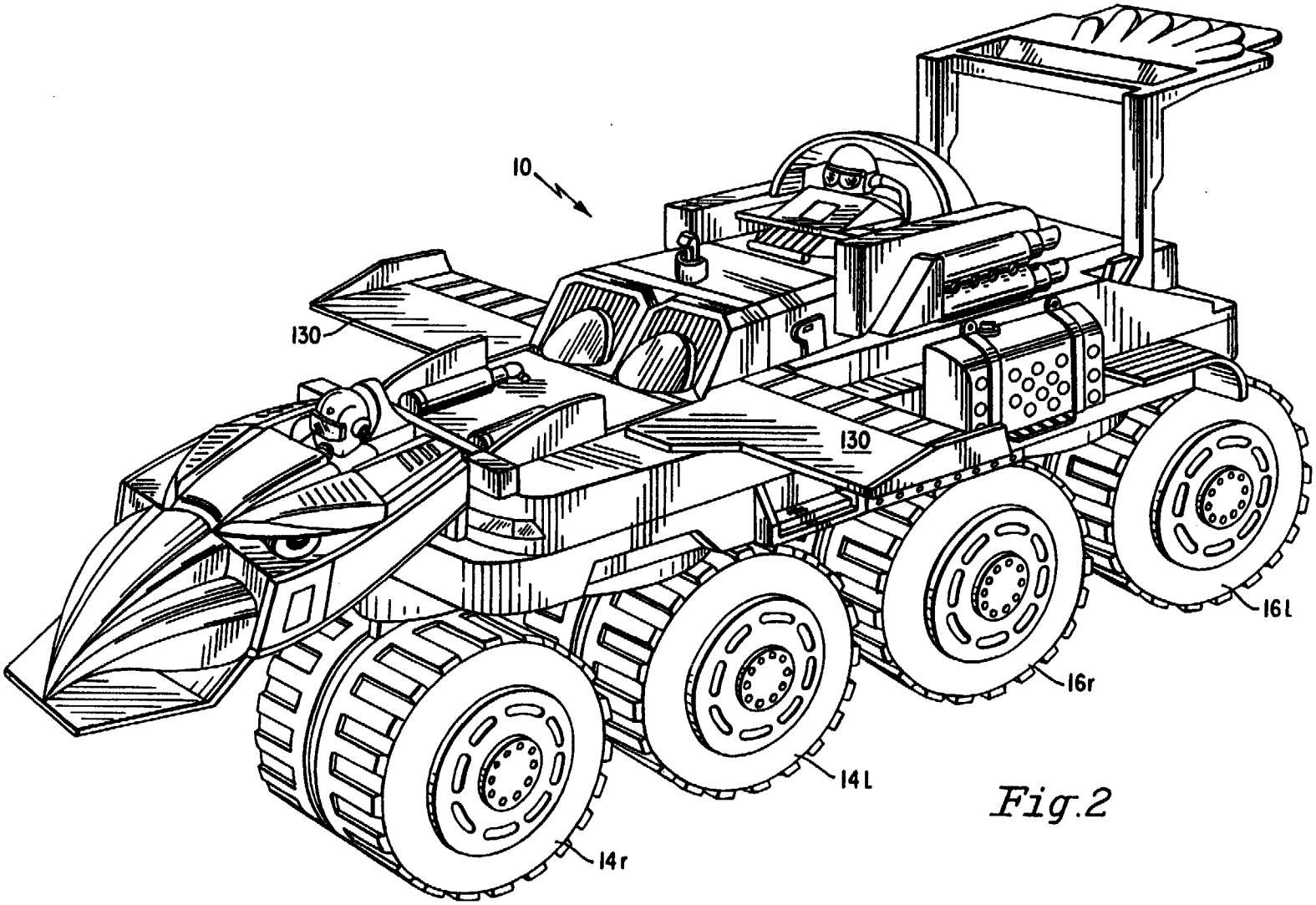

Referring now to FIGS. 1 and 2, there is illustrated a variable geometry wheeled conveyance, e.g. a vehicle, generally designated 10 having a plurality of assembled body parts connected to an underlying frame 12 (FIGS. 3–7) and formed into an identifiable configuration, in this instance, a truck. In FIG. 1 the wheeled conveyance is illustrated in a first configuration. In this representative example, a main frame 12 mounts front and rear pairs of wheels 14 and 16, respectively, the pairs of wheels being longitudinally spaced one from the other for rotation about longitudinally spaced transversely extending front and rear axes. As indicated previously, the first configuration embraces at least three wheels, e.g. a tricycle configuration. Thus, at least two of the wheels in the first configuration of the conveyance have axes longitudinally spaced from one another, e.g. a single front wheel and a pair of rear wheels or vice versa, the pair of wheels having a common axis spaced longitudinally from the axis of the single wheel. The pair of wheels establish a predetermined track when the conveyance is in its first configuration. It is within the scope of this invention that at least three wheels are used and that any number of additional wheels may be employed in the conveyance.

In FIG. 2, the vehicle 10 of FIG. 1 is illustrated in an "in-line," "tandem" or second configuration. In this configuration, the wheels of the vehicle have been transformed from the first configuration of FIG. 1 into the second configuration with the transverse axis of each wheel being longitudinally spaced from the transverse axis of every other wheel and with a track less than the predetermined track of the wheels in the first configuration. Thus, in the specific embodiment, the wheels have been transformed from the illustrated conventional four-wheel configuration of FIG. 1 into an in-line configuration with the transverse axes of rotation of the wheels lying generally parallel to and longitudinally spaced from one another. In this specific embodiment of the second configuration, the wheels lie in a common plane in the direction of travel and hence have a zero track. In this specific embodiment of a four-wheel conveyance, the front wheels have been transformed such that the right front wheel **14*r* in the first conveyance configuration of FIG. 1 is located in front of the left front wheel 14*l*** of the pair of front wheels.

Similarly, the pair of rear wheels has been transformed from the configuration of FIG. 1 such that the right wheel 16*r* is longitudinally spaced in front of the left wheel 16*l*. As described hereinafter, body parts of the conveyance are also movable during transformation between the first and second configuration to change the appearance of the conveyance. For example, the truck-like appearance of FIG. 1 may be transformed to a racing vehicle with wings, a spoiler, and a bullet nose as illustrated in FIG. 2. Alternatively, of course, the body of the conveyance need not transform upon transformation of its mode of conveyance, i.e., between the first and second wheel configurations.

In a tricycle configuration, the single front or back wheel would remain in position in both configurations while the pair of back or front wheels respectively would move to an in-line position wherein the axes of all wheels are generally transversely parallel and longitudinally spaced relative to one another. It will be appreciated from a review of FIGS. 1–4 that the conveyance is movable in a generally longitudinal direction in both the first and second configurations of the conveyance enable movement of the conveyance.

Figure 3:
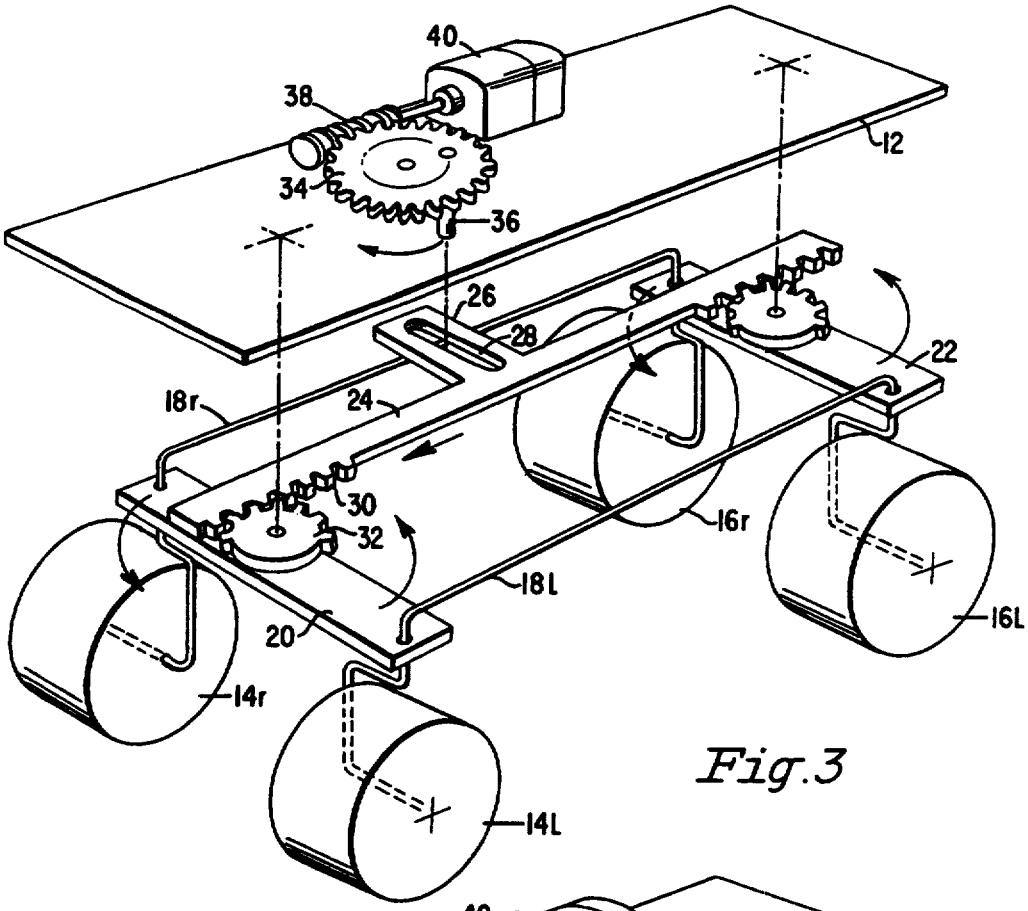
FIGS. 3 and 4 are schematic perspective views with parts in exploded juxtaposition to illustrate the first and second configurations of the conveyance and the transformation therebetween.
Figure 4:
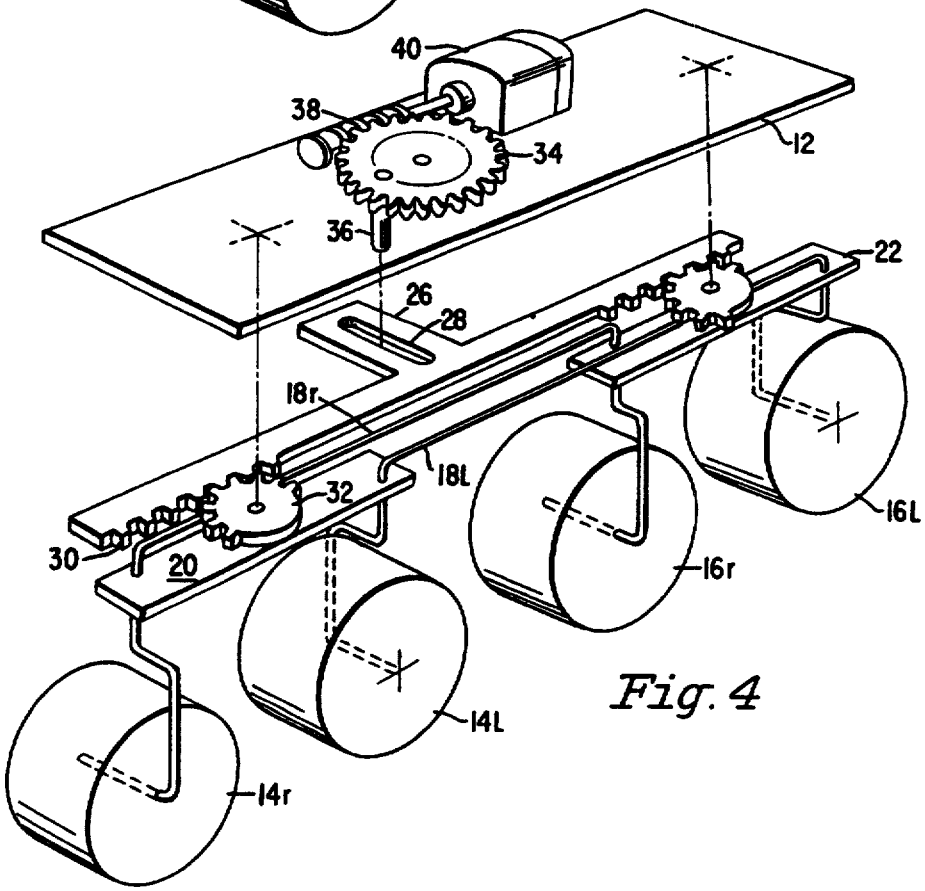

Referring specifically to the schematic illustrations of the conveyance 10 in FIGS. 3 and 4, means are provided connecting between frame 12 and the front and rear wheels 14 and 16 for effecting a transformation of the conveyance from one configuration to the other and include a parallelogram type linkage. For example, left and right chassis elements 18*l* and 18*r*, respectively, pivotally connect at opposite ends with front and rear cross links 20 and 22. The front and rear cross links are suitably pivotally secured to frame 12 to enable movement of the linkage between the orthogonal rectilinear parallelogram configuration of FIG. 3 and the non-orthogonal rectilinear parallelogram linkage of FIG. 4. By displacing the linkage between the two configurations, the two different modes of operation of the conveyance are obtained.

Means are provided connecting between the frame and the parallelogram linkage coupled to the wheels for positively displacing the wheels between the first and second configurations. The positive displacing means may comprise a rack shuttle 24 having a laterally projecting arm 26 with a transversely extending slot 28. Gear teeth 30 are provided adjacent opposite ends of rack shuttle 24 and engage gears 32 fixed to the front and rear cross links 20 and 22, respectively. Consequently, by displacing the rack shuttle 24 longitudinally of frame 12, cross links 20 and 22 are pivoted about spaced vertical axes to transform the conveyance from the first configuration to the second configuration, e.g., from a four-wheel conveyance configuration into an in-line or tandem configuration. The positive displacement means may for example include a gear 34 having a projecting pin 36 receivable through the frame in the slot 28 of arm 26, the gear 34 being driven by a worm gear 38 coupled to a reversible electric motor 40. Hence, by driving the motor in one direction, tear 34 rotates to engage pin 36 in slot 28 and displace rack shuttle 24 in a longitudinal direction. By reversing the direction of the motor, the rack shuttle is positively displaced in the opposite direction. By longitudinally displacing the rack shuttle, it rotates the cross links 20 and 22 whereby the conveyance may be transformed between its two illustrated configurations of FIGS. 3 and 4 respectively. The foregoing schematic illustrations of FIGS. 3 and 4 are intended to provide a general overall view of the concept of the present invention, a specific embodiment of the present invention being illustrated in FIGS. 5–7 which will now be described in detail.

Figure 5:
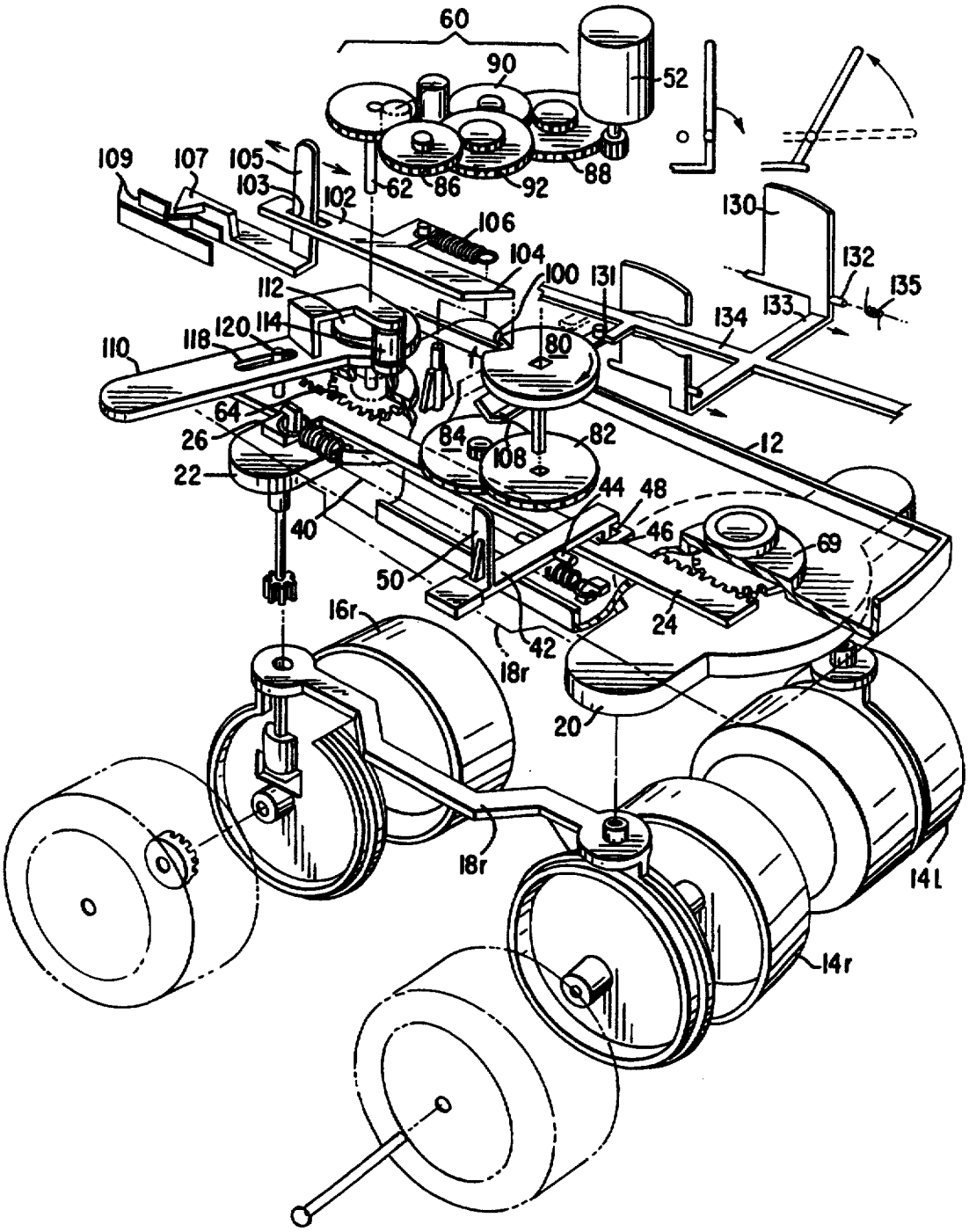
FIGS. 5 is a exploded perspective view illustrating an embodiment of a conveyance according to the present invention.
Figure 6:
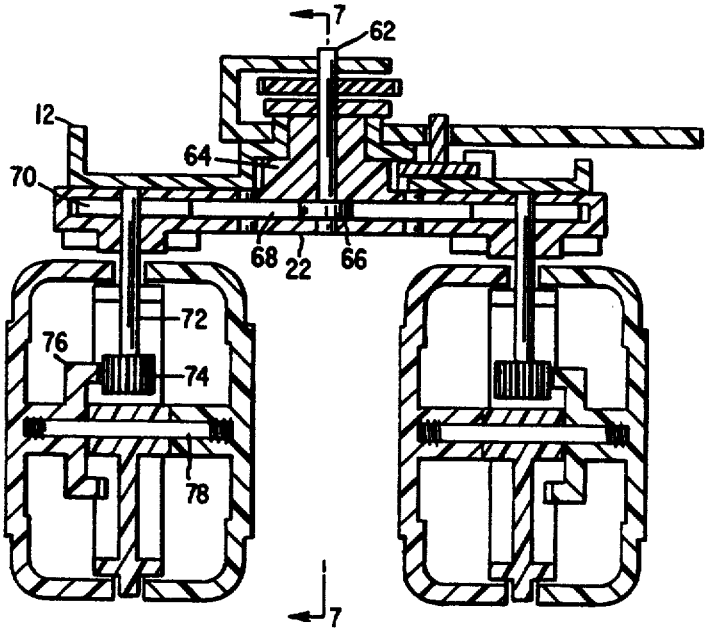
FIGS. 6 and 7 are transverse and longitudinal cross-sectional views of the conveyance illustrated in FIG. 5 in an assembled condition but without the body covering parts illustrated in FIGS. 1 and 2.
Figure 7:
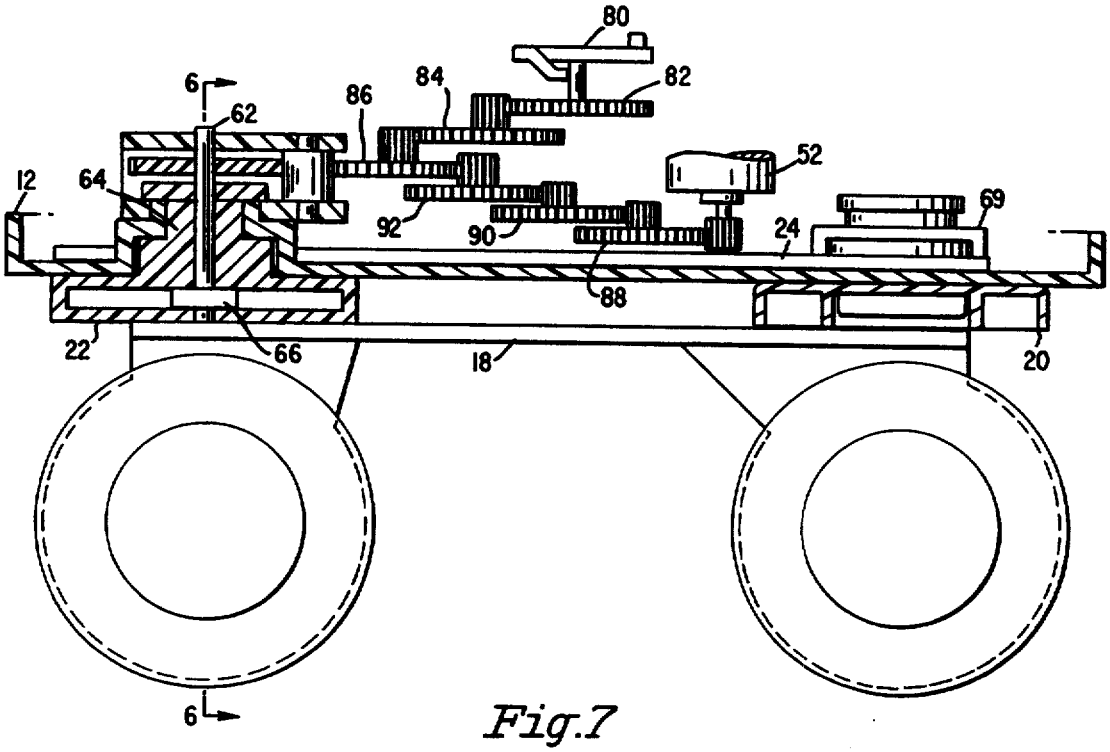

Referring now to FIGS. 5–7, like reference numerals are applied to like parts as applied in the schematic representations of the invention of FIGS. 3 and 4. Thus, as illustrated in FIG. 5, there is disclosed a pair of front wheels 14*r* and 14*l*, and a pair of rear wheels 16*r* and 16*l*. These wheels are mounted on a parallelogram type linkage including front and rear cross links 20 and 22 as well as left and right chassis elements 18*r* and 18*l*. In this form, however, the means for positively displacing the wheels between the first and second configurations includes a spring 40 having opposite ends connected to frame 12 and a transversely extending arm 26 of rack shuttle 24, respectively. Spring 40 biases rack shuttle 24 for movement in the forward direction, i.e. in a direction transforming the conveyance from the illustrated four-wheel or first configuration to an in-line or second configuration. Means are provided for releasably locking the rack shuttle 24 in the illustrated configuration and against movement under the bias of spring 40 from the first to the second configuration. To accomplish this, a rack shuttle lever 42 is pivotally mounted to frame 12 by pinion 44 received in corresponding openings in frame 12. One end of lever 42 carries a locking lug 46 which is received in a slot 48 of the rack shuttle 24. Adjacent its opposite end, lever 42 carries an upstanding trigger arm 50. Thus, by pressing down on trigger arm 50, lever 42 pivots to remove lug 46 from the slot 48 releasing the rack shuttle 24 for longitudinal movement under the bias of spring 40. As will be recalled, longitudinal movement of rack shuttle 24 pivots cross links 20 and 22 into the second configuration with the wheels in-line as in FIG. 4 and rotatable about longitudinally spaced, discrete transverse axes.

Motive means are carried by the conveyance for rotating, i.e., driving, at least one of the pairs of front or rear wheels in both the first and second configurations of the conveyance to power the conveyance for movement in a longitudinal direction. To accomplish this, there is provided an electric motor 52 which drives through a reduction gearing 60 and a drive gear 112 a shaft 62 pivotally mounted on frame 12 and passing through an upstanding gear boss 64 mounted on the rear cross link 22. The lower end of shaft 62 carries a drive gear 66 (FIG. 6) which, through a pair of idler gears 68 on opposite sides of drive gear 66, drives gears 70 at the opposite outer ends of the rear cross link 22. The end drive gears 70 rotate shafts mounting the rear wheels 18*r* and 18*l*. The drive shaft 72 carries at its lower end a gear, for example. a beveled gear 74 engaging a gear 76 forming part of the wheel for rotating the wheel about an axle 78. Consequently, drive for the rear wheels is provided from motor 52 through the gear reduction 60, drive shaft 62 and gear 66, idler gears 68, drive gears 70, shafts 72, beveled gears 74 and gears 76 to the wheels 16. Because the rear cross link 22 is mounted for pivotal movement about the axis of drive shaft 62, the drive from the motor 52 is continuous for each configuration of the conveyance.

A timing mechanism is provided for enabling the displacing means to displace the wheels from the first configuration to the second configuration after lapse of a predetermined time interval. The timing mechanism includes a timing wheel 80 pivotally carried by the frame and driven by an underlying gear 82. Gear 82 is driven by a gear 84 in turn driven by a gear 86. Gear 86 is driven from electric motor 52 through intermeshing gears 88, 90 and 92. Gears 86, 88, 90, 92 and 86 form part of the reduction gearing 60. It will be appreciated that the timing gear 80 is continuously driven by the electric motor 52 via gears 88, 90, 92, 86, 84 and 82.

Timing gear 80 has a notch 100 formed along an edge thereof. A switch cam 102 is carried for longitudinal sliding movement on frame 12. Switch arm 102 has a cam follower 104 biased to engage in the notch 100 of timing gear 80 by a spring 106. Timing gear 80 also carries a laterally projecting cam 108 which, after a predetermined lapse of time and rotation of gear 108, engages trigger arm 50 to pivot lever 42 to remove the lug 46 from slot 48 thereby releasing rack shuttle 24 for longitudinal displacement by spring 40.

Switch cam 102 has a slot 103 which receives a lever 105, the slot 103 being longer than the length of lever 105 to provide play between switch cam 102 and lever 105. Lever 105 is slidably mounted on the frame 12 and carries a contact actuating cam 107 for engaging contacts 109. Lever 105 is movable into three positions to effect timed or continuous operation of motor 52 and a motor off position. Rearward movement of lever 105 into its rearmost position closes contacts 109 while simultaneously allowing cam follower 104 to engage in notch 100 on the timing wheel. Contact 109 are in the electrical circuit for motor 52 and hence, in this position of lever 105, motor 52 drives the wheels through reduction gearing 60 to drive the conveyance. When the notch registers with cam follower 104 after a complete revolution of the timing gear, spring 106 advances cam 102 forwardly to engage cam follower 104 in notch 100, pulling lever 105 into an intermediate position. In that position, contacts 109 are opened to disengage motor 52 whereby the conveyance stops. By advancing lever 105 forwardly from its intermediate position, continuous operation of the motor and hence continuous operation of the conveyance is achieved. Particularly, by advancing lever 105 into its forwardmost position, there is sufficient play in the slot 102 to enable back and forth movement of switch cam 102 when cam follower 104 engages along the periphery of timing gear 80 and in notch 100 to preclude movement of lever 105 by movement of switch cam 102. Thus, timing wheel 80 will ratchet switch cam 104 without moving lever 105 and hence motor 52 is continuously energized through closed switch contacts 100 to drive the conveyance.

Means are carried by the frame for changing the speed of the conveyance when powered by motor 52 and preferably in response to displacement of the wheels from the first configuration into the second configuration. To accomplish this, a lever 110 is mounted for pivotal movement about the axis of drive shaft 62. The inner end of lever 110 also mounts the drive gear 112 for driving shaft 62. The drive for gear 112 is provided by a pinion gear 114 carried on the end of lever 110 for rotating about an axis parallel to and spaced from drive shaft 62. Pinion 114 is carried by lever 110 for pivotal movement therewith and for selective engagement with either gear 90 or gear 86 of reduction gearing 60. It will be appreciated that, when pinion 114 engages gear 90, a certain drive ratio from motor 52 to rear wheels 18 is provided. When the pinion engages gear 86 a reduced drive ratio is provided. Consequently, depending upon the pivotal location of lever 110 and the engagement of pinion 114 with either gear 86 or 90, the conveyance is driven at slow speed or fast speed, respectively.

The lever 110 includes a slot 118 which receives a pin 120 resulting from rack shuttle 24. Consequently, when the cam 108 engages trigger arm 50 to release the rack shuttle 24 for longitudinal movement and transformation of the conveyance from the first configuration to the second configuration, pin 120 simultaneously displaces lever 110 about the axis of drive shaft 62 to remove pinion 114 from engagement with gear 86 and to engage pinion 114 with gear 90 thereby driving the conveyance at a faster speed. Conversely, when the pinion 114 is displaced in the opposite direction by a reverse movement of lever 110, the engagement of pinion 114 with gear 86 slows the conveyance.

Timing gear 80 also carries a cam 131 used to initiate transformation of the body parts of the conveyance simultaneously with its transformation between first and second configurations. For example, when the conveyance is transformed from the first configuration to the second configuration, the body parts of the conveyance simultaneously transform from the truck body configuration illustrated in FIG. 1 to a racing body configuration illustrated in FIG. 2. While the movement of all of the body parts is not disclosed in the present application, an illustrated example of the manner in which certain parts move responsive to the transformation from one configuration to the other is disclosed.

In FIG. 5, the doors for the truck body cab are illustrated at 130. The doors are pivotally mounted to the frame by pins 132 and are spring-biased by spring 135 for outward pivotal movement about pins 132. Stops 133 are provided on a body shuttle 134 for preventing outward pivotal movement of the doors 130 from their upstanding vertical configuration, for example, representing wings on the racer as illustrated in FIG. 2. The body shuttle 134 is driven in the longitudinal direction by a cam 131 carried by timing wheel 80. After a lapse of a predetermined time interval, corresponding preferably to the interval necessary for the conveyance to be transformed from the first to the second configuration, the cam 131 drives body shuttle 134 forwardly carrying stops 133 with shuttle 134 forwardly past the doors. The spring-biased doors, when no longer registering with stops 133, then pivot outwardly into the position illustrated in FIG. 2 to comprise the elements representative of wings in the racing or second configuration of FIG. 2.

It will be appreciated that while the body parts may transform, the speed change and transformation between configurations occur simultaneously in the preferred embodiment hereof, they could be actuated sequentially. For example, by relocating cam 131 on the timing wheel, the body part transformation may occur before or after the configuration transformation. Also, lever 110 could be actuated by the body shuttle 134 rather than the rack shuttle whereby the speed change may occur with the body part transformation either before or after the change in configuration.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction; and means connecting said frame and said front and rear pairs of wheels for enabling displacement of said wheels from said first configuration to a second configuration without disassembly of said wheels relative to said frame, each wheel in said second configuration being rotatable about a discrete, transversely extending axis spaced longitudinally of the axis of each other wheel of said front and rear pairs of wheels, enabling the conveyance for movement in said longitudinal direction, said connecting means enabling the wheels of said front and rear pairs of wheels to lie in substantial longitudinal alignment with one another in said second configuration, whereby all wheels of said pairs thereof lie substantially in-line with one another in said second configuration.

2. A conveyance according to claim 1 wherein said connecting means includes means for positively displacing said wheels from said first configuration toward said second configuration.

3. A conveyance according to claim 1 wherein said connecting means enables displacement of said wheels from said second configuration to said first configuration.

4. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction;

means connecting said frame and said front and rear pairs of wheels for enabling displacement of said wheels from said first configuration to a second configuration wherein each wheel is rotatable about a discrete, transversely extending axis spaced longitudinally of the axis of each other wheel of said front and rear pairs of wheels, enabling the conveyance for movement in said longitudinal direction;

said connecting means including means for positively displacing said wheels from said first configuration toward said second configuration; and said positive displacing means including a spring biasing at least a part of said connecting means for movement to displace said wheels from said first configuration toward said second configuration, and means for releasably locking said connecting means to maintain said wheels in said first configuration and against the bias of said spring.

5. A conveyance according to claim 4 wherein the wheels of said first and second pairs of wheels lie in substantial longitudinal alignment with one another in said second configuration whereby all wheels of said pairs thereof lie substantially in-line with one another in said second configuration.

6. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction;

means connecting said frame and said front and rear pairs of wheels for enabling displacement of said wheels from said first configuration to a second configuration without disassembly of said wheels relative to said frame, each wheel in said second configuration being rotatable about a discrete, transversely extending axis spaced longitudinally of the axis of each other wheel of said front and rear pairs of wheels, enabling the conveyance for movement in said longitudinal direction, said connecting means enabling the wheels of said front and rear pairs thereof to lie in substantial longitudinal alignment with one another in said second configuration whereby all wheels of said pairs thereof lie substantially in-line with one another in said second configuration; and said connecting means including, in said first configuration of said wheels, generally longitudinally extending, transversely spaced, side elements and generally transversely extending, longitudinally spaced, end elements pivoted to one another to form a generally parallelogram linkage, and means interconnecting said frame and one of said elements for pivoting said linkage from a generally orthogonal rectilinear configuration establishing said first configuration to a non-orthogonal rectilinear configuration establishing said second configuration.

7. A conveyance according to claim 6 wherein one of said end elements is rotatable about a generally vertical axis normal to said longitudinal and transverse directions, and drive means cooperable between said frame and said one end element for rotating said one end element about said vertical axis to pivot said linkage and displace said wheels from said first configuration toward said second configuration.

8. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction;

means connecting said frame and said front and rear pairs of wheels for enabling displacement of said wheels from said first configuration to a second configuration wherein each wheel is rotatable about a discrete, transversely extending axis spaced longitudinally of the axis of each other wheel of said front and rear pairs of wheels, enabling the conveyance for movement in said longitudinal direction; and said connecting means including means interconnecting said frame and said front and rear pairs of wheels for positively displacing said wheels from said first configuration toward said second configuration, and a timing mechanism carried by said frame and connected to said positive displacing means for enabling said positive displacing means to displace said wheels between said configurations after lapse of a predetermined time interval.

9. A conveyance according to claim 8 wherein the wheels of said first and second pairs of wheels lie in substantial longitudinal alignment with one another in said second configuration whereby all wheels of said pairs thereof lie substantially in-line with one another in said second configuration.

10. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction;

means connecting said frame and said front and rear pairs of wheels for enabling displacement of said wheels from said first configuration to a second configuration without disassembly of said wheels relative to said frame, each wheel in said second configuration being rotatable about a discrete, transversely extending axis spaced longitudinally of the axis of each other wheel of said front and rear pairs of wheels, enabling the conveyance for movement in said longitudinal direction, said connecting means enabling the wheels of said front and rear pairs thereof to lie in substantial longitudinal alignment with one another in said second configuration whereby all wheels of said pairs thereof lie substantially in-line with one another in said second configuration; and motive means carried by said conveyance or rotating at least one of said front and rear pairs of wheels in both said first and second configurations to power the conveyance for movement in said longitudinal direction.

11. A conveyance according to claim 10 including means carried by said frame for changing the speed of said conveyance when powered by said motive means.

12. A conveyance according to claim 11 wherein said speed changing means is responsive to displacement of said front and rear pairs of wheels from said first configuration into said second configuration.

13. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction;

means connecting said frame and said front and rear pairs of wheels for enabling displacement of said wheels from said first configuration to a second configuration wherein each wheel is rotatable about a discrete, transversely extending axis spaced longitudinally of the axis of each other wheel of said front and rear pairs of wheels, enabling the conveyance for movement in said longitudinal direction; and said connecting means including means for positively displacing said wheels from said first configuration toward said second configuration, a timing mechanism carried by said frame for actuating said positive displacing means after lapse of a predetermined time interval whereby, upon movement of said conveyance in said longitudinal direction in said first configuration for said predetermined time interval, said positive displacing means is actuated to displace said wheels into said second configuration, enabling continued movement of said conveyance in said second configuration in said longitudinal direction.

14. A conveyance according to claim 13 including motive means carried by said frame for rotating at least one of said front and rear pairs of wheels in both said first and second configurations to power the conveyance for movement in said longitudinal direction.

15. A conveyance according to claim 13 wherein the wheels of said first and second pairs of wheels lie in substantial longitudinal alignment with one another in said second configuration whereby all wheels of said pairs thereof lie substantially in-line with one another in said second configuration.

16. A variable geometry wheeled conveyance comprising:

a main frame;

front and rear pairs of wheels;

means connecting said front and rear pairs of wheels and said main frame establishing first and second configurations of said wheels, said pairs of front and rear wheels in said first configuration being longitudinally spaced from one another for rotation about longitudinally spaced, transversely extending front and rear axes, respectively, enabling the conveyance for movement in a longitudinal direction, each wheel of said front and rear pairs of wheels in said second configuration being rotatable about a discrete transversely extending axis spaced longitudinally of the axis of each other wheel of said front and rear pairs of wheels enabling the conveyance for continued movement in said longitudinal direction;

said connecting means enabling displacement of said wheels from one of said first and second configurations to another of said first and second configurations without disassembly of said wheels relative to said frame and enabling the conveyance for continued movement in said longitudinal direction in said another configuration; and said connecting means enabling the wheels of said front and rear pairs of wheels to lie in substantial longitudinal alignment with one another in said second configuration whereby all wheels of said pairs thereof lie substantially in-line with one another in said second configuration.

17. A conveyance according to claim 16 wherein said connecting means includes means for positively displacing said wheels from said one of said first and second configurations to another of said first and second configurations.

18. A variable geometry wheeled conveyance comprising:

a main frame;

front and rear pairs of wheels carried by said frame and longitudinally spaced from one another for rotation about longitudinally spaced, transversely extending, front and rear axes, respectively, in a first configuration enabling the conveyance for movement in a longitudinal direction;

means connecting said frame and said front and rear pairs of wheels for enabling displacement of said wheels from said first configuration to a second configuration without disassembly of said wheels relative to said frame, each wheel in said second configuration being rotatable about a discrete, transversely extending axis spaced longitudinally of the axis of each other wheel of said front and rear pairs of wheels, enabling the conveyance for movement in said longitudinal direction, said connecting means enabling the wheels of said front and rear pairs thereof to lie in substantial alignment with one another in said second configuration whereby all wheels of said pairs thereof lie substantially in-line with one another in said second configuration; and a plurality of body parts carried by said frame, at least one of said body parts being movable from a first predetermined position on said frame in said first configuration of said conveyance to a second predetermined position on said frame in said second configuration of said conveyance, and means carried by said frame responsive to transformation from said first configuration to said second configuration for moving said one body part from said first position into said second position.

19. A variable geometry wheeled conveyance comprising:

a main frame;

front and rear pairs of wheels;

means connecting said front and rear pairs of wheels and said main frame establishing first and second configurations of said conveyance, said pairs of front and rear wheels in said first configuration being longitudinally spaced from one another for rotation about longitudinally spaced, transversely extending front and rear axes, respectively, enabling the conveyance for movement in a longitudinal direction, each wheel of said front and rear pairs of wheels in said second configuration being rotatable about a discrete transversely extending axis spaced longitudinally of the axis of each other wheel of said front and rear pairs of wheels enabling the conveyance for continued movement in said longitudinal direction, said connecting means enabling the wheels of said front and rear pairs thereof to lie in substantial longitudinal alignment with one another in said second configuration whereby all wheels of said pairs thereof lie substantially in-line with one another in said second configuration;

said connecting means enabling displacement of said wheels from one of said first and second configurations to another of said first and second configurations without disassembly of said wheels relative to said frame and enabling the conveyance for continued movement in said longitudinal direction in said another configuration;

said connecting means including, in said first configuration of said wheels, generally longitudinally extending, transversely spaced, side elements and generally transversely extending, longitudinally spaced, end elements pivoted to one another to form a generally parallelogram linkage, and means interconnecting said frame and one of said elements for pivoting said linkage from a generally orthogonal rectilinear configuration establishing said first configuration to a non-orthogonal rectilinear configuration establishing said second configuration.

20. A variable geometry wheeled conveyance comprising:

a main frame;

front and rear pairs of wheels;

means connecting said front and rear pairs of wheels and said main frame establishing first and second configurations of said wheels, said pairs of front and rear wheels in said first configuration being longitudinally spaced from one another for rotation about longitudinally spaced, transversely extending front and rear axes, respectively, enabling the conveyance for movement in a longitudinal direction, each wheel of said front and rear pairs of wheels in said second configuration being rotatable about a discrete transversely extending axis spaced longitudinally of the axis of each other wheel of said front and rear pairs of wheels enabling the conveyance for continued movement in said longitudinal direction;

said connecting means enabling displacement of said wheels between said first and second configurations without disassembly of said wheels relative to said frame and enabling the conveyance for continued movement in said longitudinal direction in both said first and second configurations, said connecting means enabling the wheels of said front and rear pairs thereof to lie in substantial longitudinal alignment with one another in said second configuration whereby all wheels of said pairs thereof lie substantially in-line with one another in said another configuration; and motive means carried by said conveyance for rotating at least one of said front and rear pairs of wheels in both said first and second configurations to power the conveyance for movement in said longitudinal direction.

21. A conveyance according to claim 20 including means carried by said frame for changing the speed of said conveyance when powered by said motive means.

22. A conveyance according to claim 21 wherein said speed changing means is responsive to displacement of said front and rear pairs of wheels from said one of said first and second configurations and said another of said first and second configurations.

23. A variable geometry wheeled conveyance comprising:

a main frame;

front and rear pairs of wheels;

means connecting said front and rear pairs of wheels and said main frame establishing first and second configurations of said conveyance, said pairs of front and rear wheels in said first configuration being longitudinally spaced from one another for rotation about longitudinally spaced, transversely extending front and rear axes, respectively, enabling the conveyance for movement in a longitudinal direction, each wheel of said front and rear pairs of wheels in said second configuration being rotatable about a discrete transversely extending axis spaced longitudinally of the axis of each other wheel of said front and rear pairs of wheels enabling the conveyance for continued movement in said longitudinal direction;

said connecting means enabling displacement of said wheels from one of said first and second configurations to another of said first and second configurations enabling the conveyance for continued movement in said longitudinal direction;

said connecting means including means interconnecting said frame and said front and rear pairs of wheels for positively displacing said wheels from said one of said first and second configurations to another of said first and second configurations, and a timing mechanism carried by said frame and connected to said positive displacing means for enabling said positive displacing means to displace said wheels between said configuration after lapse of a predetermined time interval.

24. A conveyance according to claim 23 wherein the wheels of said first and second pairs of wheels lie in substantial longitudinal alignment with one another in said second configuration whereby all wheels of said pairs thereof lie substantially in-line with one another in said second configuration.

25. A variable geometry wheeled conveyance comprising:

a main frame;

a pair of wheels and at least a third wheel carried by said frame, said pair of wheels and said third wheel being longitudinally spaced from one another for rotation about longitudinally spaced transversely extending axes, respectively, in a first configuration of said wheels, enabling the conveyance for movement in a longitudinal direction;

means connecting said frame and said pair of wheels for enabling displacement of said pair of wheels from a first orientation in said first configuration of said wheels to a second orientation in a second configuration of said wheels wherein each wheel of said pair of wheels and said third wheel is rotatable about a discrete transversely extending axis spaced longitudinally of the axis of each other wheel thereof, enabling the conveyance for movement in said longitudinal direction in said second configuration.

said connecting means enabling the wheels of said pair of wheels without disassembly of said pair of wheels relative to said frame to lie in substantial longitudinal alignment with one another and with said third wheel in said second configuration whereby all wheels of said pair of wheels and said third wheel lie substantially in-line with one another in said second configuration.

* * * * *